United States Patent [19]

Fletcher

[11] Patent Number: 4,802,260

[45] Date of Patent: Feb. 7, 1989

[54] CRAB OPENER APPARATUS

[76] Inventor: Justin Fletcher, 1216 Carolina Ave., Lynn Haven, Fla. 32444

[21] Appl. No.: 244,094

[22] Filed: Sep. 14, 1988

[51] Int. Cl.[4] ..... A22C 29/04

[52] U.S. Cl. ..... 17/76

[58] Field of Search ..... 17/74, 75, 76, 48

[56] References Cited

U.S. PATENT DOCUMENTS 3,631,567 1/1972 Reinke ..... 17/76

4,393,545 7/1983 O'Donnell ..... 17/76

*Primary Examiner*—Willie G. Abercrombie

*Attorney, Agent, or Firm*—William M. Hobby, III

[57] ABSTRACT

A crab opener apparatus has a base with a fixed blade attached thereto and a slidable blade slidably mounted to the base and positioned next to the fixed blade in one position so that the two blades are parallel and adjacent to each other. An aperture in the fixed blade has a rod passing therethrough and is fixedly attached to the sliding blade on one end and has a handle attached to the other end. The blades are positioned together so that a crab placed thereon when the handle is hit to slide the slidable blade away from the fixed blade pops the crab shell off.

9 Claims, 1 Drawing Sheet

FIG. 1
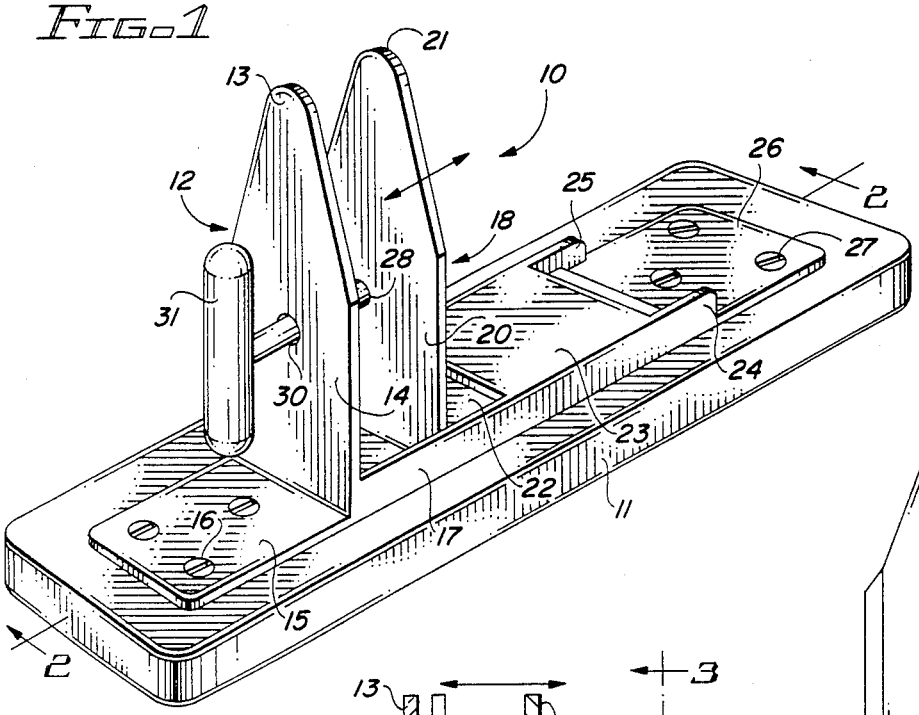
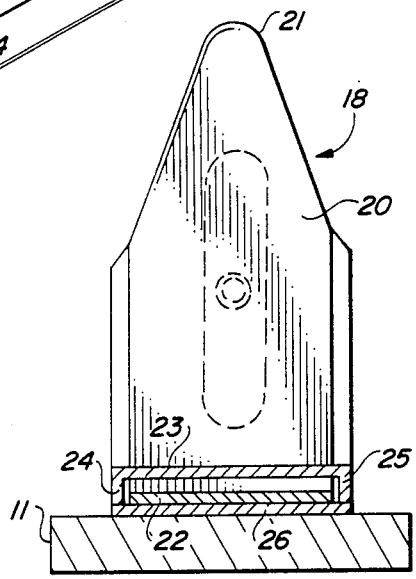
FIG. 3
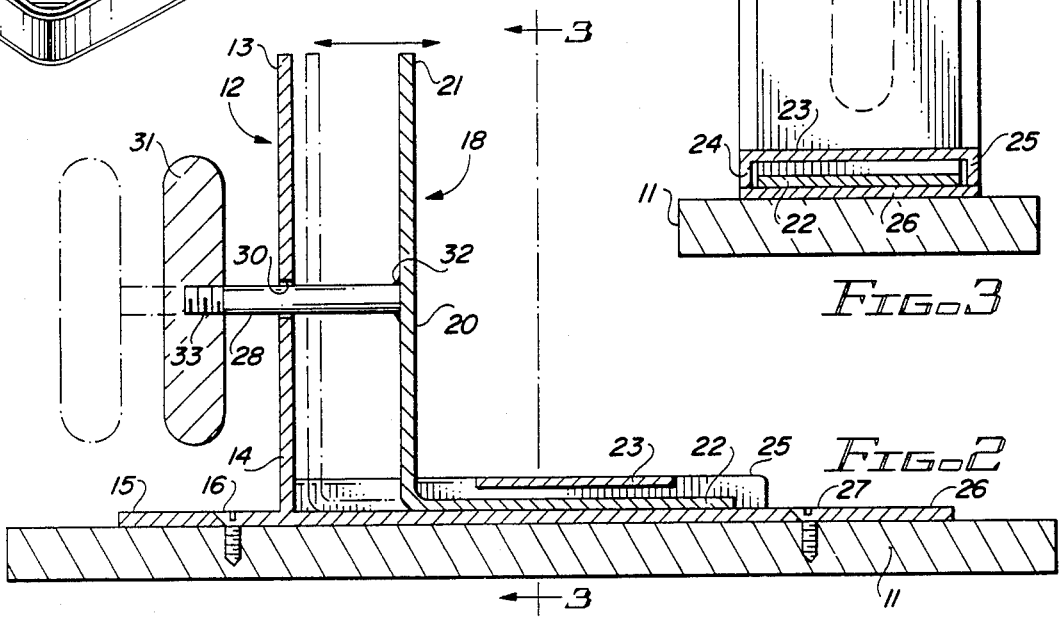
FIG. 2
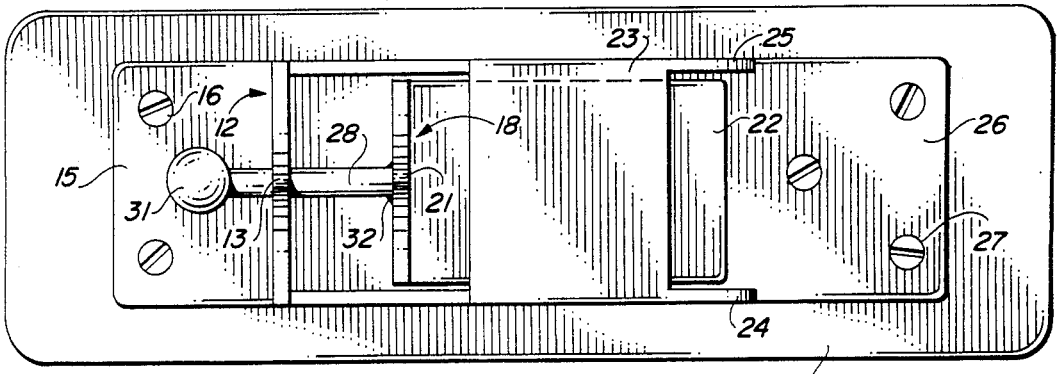
FIG. 4

CRAB OPENER APPARATUS

BACKGROUND OF THE INVENTION

The present invention relates to a crab opener and especially to a crab opener for breaking the crab shell off of a crab for access to the crab meat.

In the past, it has been common to capture crabs in crab baskets and through crab lines and the like and especially the common Blue Crab found along the Atlantic Coastline of the United States. The crabs are cooked by boiling them in water and then the legs may be eaten by cracking the legs for access to the crab meat. However, a portion of the meat also resides between the crab shells so that the crab shell must be removed for access. In commercial operations the crabs are sliced through the middle thereof so that the shells can be broken loose and the edible crab meat removed.

The present invention is for home or restaurant use where the crabs are frequently hand processed. In many cases it is desirable to remove the top shell as a whole shell for use in the make-up of deviled crabs and the like. The crab meat is used to make up the deviled crab constituents which are then formed onto the crab shell where they have been cooked in an oven. In addition, raw bars typically need to have an easy way to open crabs for easy access to the meat other than the meat in the claws.

The present invention provides an easy and fast method for opening the crab without damaging the meat or the shells in a rapid and efficient manner.

SUMMARY OF THE INVENTION

The present invention relates to a crab opener and especially to a manual crab opener which has a base and fixed and slidable blades mounted thereon. The fixed blade is fixedly attached to the base and has an aperture therein while the slidable blade extends generally parallel to the fixed blade and is slidably mounted to the base in a sliding track and slides between a first position adjacent the fixed blade and a second position separated from the fixed blade. An elongated rod is connected to the slidable blade and extends through the aperture in the fixed blade and has a handle attached to the other end thereof so that the slidable blade may be moved between its first and second positions by pushing or slamming against the handle. The crab is pierced with the tips of both blades when they are adjacent each other and pushed into the mouth area of the crab between the shells. The handle is then hit to slide the blades apart for breaking the shell off the crab. In the preferred embodiment the blades extend in a perpendicular direction from the base and have arcuated pointed tips. The slidable blade has a perpendicular guide portion extending from the bottom thereof which slides in a track.

BRIEF DESCRIPTION OF THE DRAWINGS

Other objects, features and advantages of the present invention will be apparent from the written description and the drawings in which:

FIG. 1 is a perspective view of a crab opener in accordance with the present invention;

FIG. 2 is a sectional view taken on line 2—2 of FIG. 1;

FIG. 3 is a sectional view taken on the line 3—3 of FIG. 2; and

FIG. 4 is a top plan view of the crab opener of FIGS. 1 through 3.

DESCRIPTION OF THE PREFERRED EMBODIMENT

Referring to FIGS. 1 through 4, a crab opener 10 is illustrated having a base 11 having a fixed blade 12 having a curved or pointed tip 13 on the end of an upright extending portion 14 which is perpendicular to the base 11. The fixed portion has a perpendicular mounting portion 15 perpendicular to the upright portion 14 and parallel to the base 11 and attached to the base 11 with a plurality of screws 16. In the preferred embodiment a track 17 is also attached to the fixed blade 12 for the sliding blade 18 to slide in. The sliding blade 18 has an upwardly extending portion 20 with a rounded tip 21 and a perpendicular portion 22 which is also parallel to the base 11. The sliding perpendicular portion 22 slides under a cross plate 23 connected between side track portions 24 and 25 extending from the fixed blade 14. A base plate portion 26 of the track also has a plurality of threaded fasteners 27 for attaching the track to the base 11. The sliding blade 18 has an elongated rod 28 fixedly attached to one side thereof and extending through an aperture 30 on the fixed blade 12 and having a handle or driving portion 31 attached to the end of the elongated rod 28. The rod 28 is attached with a weld 32 in the drawing as illustrated in FIG. 2 while the handle 31 is attached with a threaded portion 33 on the end of the rod 28. It will, of course, be clear that the handle and rod can be attached in other manners as desired and the handle can be any shape desired without departing from the spirit and scope of the invention.

In operation, the sliding blade 18 is placed in a first position shown by the phantom lines in FIG. 2 with the blades 18 and 12 adjacent each other and parallel with the tips 13 and 21 next to each other, so that a crab's mouth can be slipped over the tips 13 and 21 simultaneously. The handle 31 can then be hit with the hand or fist to pop the shells loose as the blade 18 is driven from the first position to the second position as shown in FIG. 2. The handle can then be used to pull the blades back together for placing another crab thereon.

The entire crab opener can be made of stainless steel including stainless steel threaded fasteners. In the preferred embodiment the entire unit is made of stainless steel except for the base 11 which may be made of a polymer material or a coated wood. The unit may also be mounted with fasteners 16 and 27 directly to a cabinet if desired. Accordingly, the present invention is not to be considered limited to the forms shown which are to be considered illustrative rather than restrictive.

I claim:

1. A crab opener comprising:

a base;

a fixed blade fixedly attached to said base, said fixed blade having an aperture therein;

a slidable blade extending generally parallel to said fixed blade and slidably mounted to said base, said slidable between a first position adjacent said fixed blade and a second position separated from said fixed blade;

a rod connected to said slidable blade and extending through said aperture in said fixed blade; and a handle attached to said rod for moving said rod and slidable blade between first and second positions when a crab is positioned on adjacent fixed and slidable blades.

2. A crab opener in accordance with claim 1 in which a track is fixedly attached to said base for said slidable blade to slide in.

3. A crab opener in accordance with claim 2 in which said slidable blade has a perpendicular portion extending therefrom and riding in said track fixedly attached to said base.

4. A crab opener in accordance with claim 3 in which said track has a bottom two sides and a top plate for said perpendicular portion of said slidable blade to slide in.

5. A crab opener in accordance with claim 4 in which said fixed blade has a perpendicular portion fixedly attached to said base with threaded fasteners.

6. A crab opener in accordance with claim 5 in which said track attached to said base is attached to said fixed blade for holding one end of said track to said base.

7. A crab opener in accordance with claim 6 in which said track is attached at one end with threaded fasteners to said base.

8. A crab opener is accordance with claim 7 in which said fixed blade and said slidable blade each have an arcuate blade tip on the end thereof.

9. A crab opener in accordance with claim 8 in which said fixed blade and said slidable blade are mounted generally perpendicular to said base.

* * * * *